US005667125A

United States Patent [19]

Köfferlein et al.

[11] Patent Number: 5,667,125

[45] Date of Patent: Sep. 16, 1997

[54] DEVICE FOR TRANSPORTING PRINTING MEDIA IN PRINTERS OR COPIERS

[75] Inventors: Rainer Köfferlein; Joachim Hoffmann, both of München, Germany

[73] Assignee: Oce Printing Systems GmbH, Boing, Germany

[21] Appl. No.: 586,679

[22] PCT Filed: Jul. 18, 1994

[86] PCT No.: PCT/DE94/00823

§ 371 Date: Jan. 25, 1996

§ 102(e) Date: Jan. 25, 1996

[87] PCT Pub. No.: WO95/04308

PCT Pub. Date: Feb. 9, 1995

[30] Foreign Application Priority Data

Jul. 28, 1993 [DE] Germany ..... 43 25 357.1

[51] Int. Cl.[6] ..... B65H 20/00

[52] U.S. Cl. ..... 226/191

[58] Field of Search ..... 226/191, 189, 226/190

[56] References Cited

U.S. PATENT DOCUMENTS

| | | | |
|---|---|---|---|
| 5,026,045 | 6/1991 | Wirz et al. | 226/191 |
| 5,069,442 | 12/1991 | Storz . | |
| 5,098,082 | 3/1992 | Hamilton | 226/191 |
| 5,310,106 | 5/1994 | Thimon et al. | 226/191 |

FOREIGN PATENT DOCUMENTS

| | | | |
|---|---|---|---|
| 0131896 | 3/1949 | Australia | 226/191 |
| 0 432 136 | 6/1991 | European Pat. Off. . | |
| 0 432 298 | 6/1991 | European Pat. Off. . | |
| 2108085 | 9/1971 | Germany | 226/191 |
| 39 43 227 | 7/1991 | Germany . | |
| 39-19088 | 5/1964 | Japan | 226/191 |
| 59-138545 | 8/1984 | Japan . | |

OTHER PUBLICATIONS

*Patent Abstract of Japan*, vol. 7, No. 23 (P—171), 29 Jan. 1983 of JP57176067.

*Patent Abstracts of Japan*, vol. 9, No. 105 (P—354), 9 May 1985 of JP59228677.

*Patent Abstracts of Japan*, vol. 15, No. 354 (M—1155), 6 Sep. 1996 of JP3138243.

*IBM Technical Disclosure Bulletin*, vol. 35, No. 4B, Sep. 1992, pp. 456–459.

*Primary Examiner*—Daniel P. Stodola
*Assistant Examiner*—Matthew A. Kaness
*Attorney, Agent, or Firm*—Hill, Steadman & Simpson

[57] ABSTRACT

A device for transporting printing media (12) in printers or copiers has transporting elements (36), arranged rotatably in a printing medium transport channel at a distance from the printing medium (12), as a feeding aid for an automatic paper feeding device. Located on the circumferential region of the transporting elements (36) are friction elements (40) which are bound, so as to be deflectable in the manner of impact elements, to the axis of rotation (38) of the transporting elements (36) and have friction surfaces (41) which, due to centrifugal force during rotation of the transporting elements (36), move the friction elements (40) out of a rest position, counter to a restoring force, via their friction surface (41) into frictional contact with the printing medium (12) and transport the latter. The friction elements (40) release the printing medium (12) when the transporting element (36) is stationary.

13 Claims, 3 Drawing Sheets

DEVICE FOR TRANSPORTING PRINTING MEDIA IN PRINTERS OR COPIERS

BACKGROUND OF THE INVENTION

The present invention generally relates to a paper transporting device in printers, copiers and the like. More particularly, the present invention relates to a rotatable friction wheel or transporting element having friction elements, deflectable by centrifugal force, which engage the paper when driven, and which release the paper when stationary.

To increase the convenience of operation, it is known in electrophotographic printing devices operating with continuous paper to use automatic paper feeding devices. A paper feeding device of this type is described, for example, in EP-A1-0,432,298. In the known device, for the automatic threading of the continuous paper into an electrophotographic printing device through the transfer printing station and fusing station up to a delivery table, when a feeding procedure is called up, the elements of the paper transporting path and the assemblies, such as the fusing station and transfer printing station, form a paper feeding path, by means of which the continuous paper can be advanced with the aid of the tractor drive of the transfer printing station. The paper is then picked up by paper transporting rollers of a stacking device and is delivered as required. The feeding operation is controlled by an arrangement controlled by a microprocessor.

It has now been shown that simply pushing the printing medium through the paper transport channel is not sufficient, but that it is necessary to arrange additional paper transporting elements in the form of an auxiliary drive in the paper transport channel, which auxiliary drive automatically conveys the sheet fed into the paper transporting device right into the stacker. Owing to the use of heating saddles in the fusing station of such printing devices, no such paper transporting elements can be arranged below the sheet. In the case of mounting the paper transporting elements above the sheet, it must be ensured that these elements can under no circumstances touch the paper during the printing operation as otherwise the toner images, arranged loosely on the printing medium, become smudged prior to fusing.

In order to fulfil the requirements, the previously known solutions, as are described, for example, in Japan Abstract Volume 7, No. 23 (P-171) (1168) of 29 Jan. 1983, Japan Patent 57/176067, require a relatively large outlay, partly for the mechanism required for this purpose and partly for the appropriate monitoring devices.

From the literature source, IBM Technical Disclosure Bulletin, Vol. 35, No. 4B, September 1992, New York, US, pages 456–459, a device is known for aligning single sheets in a single-sheet printer. That device includes two motor-driven aligning elements which pick up the single sheets and align them on stops. For this purpose, two whips in the form of elongate rods are arranged in each case in guides of a holder, which whips are deflected due to centrifugal force during a rotary movement of the holder and thus come into contact with the single sheets. To increase the friction with the single sheets, the front ends of the whip carriers are of hollow design.

The object of the invention is therefore to provide a device for transporting printing media in printers or copiers with the aid of friction elements, in which the friction elements can be engaged with and disengaged from the printing medium in a simple manner whilst eliminating a need for pivoting devices. In particular, the device should be suitable as an auxiliary drive for an automatic printing medium feeding device in printers and copiers.

SUMMARY OF THE INVENTION

In order to achieve the aforementioned objects, a device is provided for frictionally engaging and transporting printing media in a copier or printer. The device includes at least one transporting element which is unitarily formed from a flexible elastic material. The transporting element is drivable to rotate on an axis. The transporting element includes a plurality of circumferential friction elements formed therein, each friction element having a friction surface located at a circumference of the transporting element. Each friction element is deflectable radially outward from a rest position to an engaging position. During operation, rotation of the transporting element causes the friction elements to deflect to the engaging position for frictional driving engagement with a printing medium. Each friction element is biased by a restoring force to move radially inward to the rest position when the transporting element is stationary.

In the invention, pairs of friction wheels are arranged in the printing medium transport channel above the actual sheet of paper, which friction wheels are designed in such a way that, when stationary, they have a diameter with which a sufficient minimum distance from the web of paper is maintained. When the friction wheels are set in rotation, wheel segments pivot outwards due to centrifugal force and thus enlarge the wheel diameter and its enveloping circle to the extent that the sheet of paper is contacted and is driven by the available friction.

The solution merely requires drive motors, with friction wheels arranged on their axes, and no separate pivoting means or monitoring devices.

The invention is particularly suitable for use in electrophotographic printing devices which process printing media of different widths. By means of the arrangement of the friction wheels or transporting elements in pairs, all the sheets of paper lying between threshold values in terms of their width are transported straight through the paper transport channel without any special adjustments being required by the operating personnel in dependence on the width of the printing medium.

Additional features and advantages of the present invention are described in, and will be apparent from, the detailed description of the presently preferred embodiments and from the drawings.

Embodiments of the invention are illustrated in the drawings and are described in detail below by way of an example.

DETAILED DESCRIPTION OF THE PRESENTLY PREFERRED EMBODIMENTS

Figure 1:
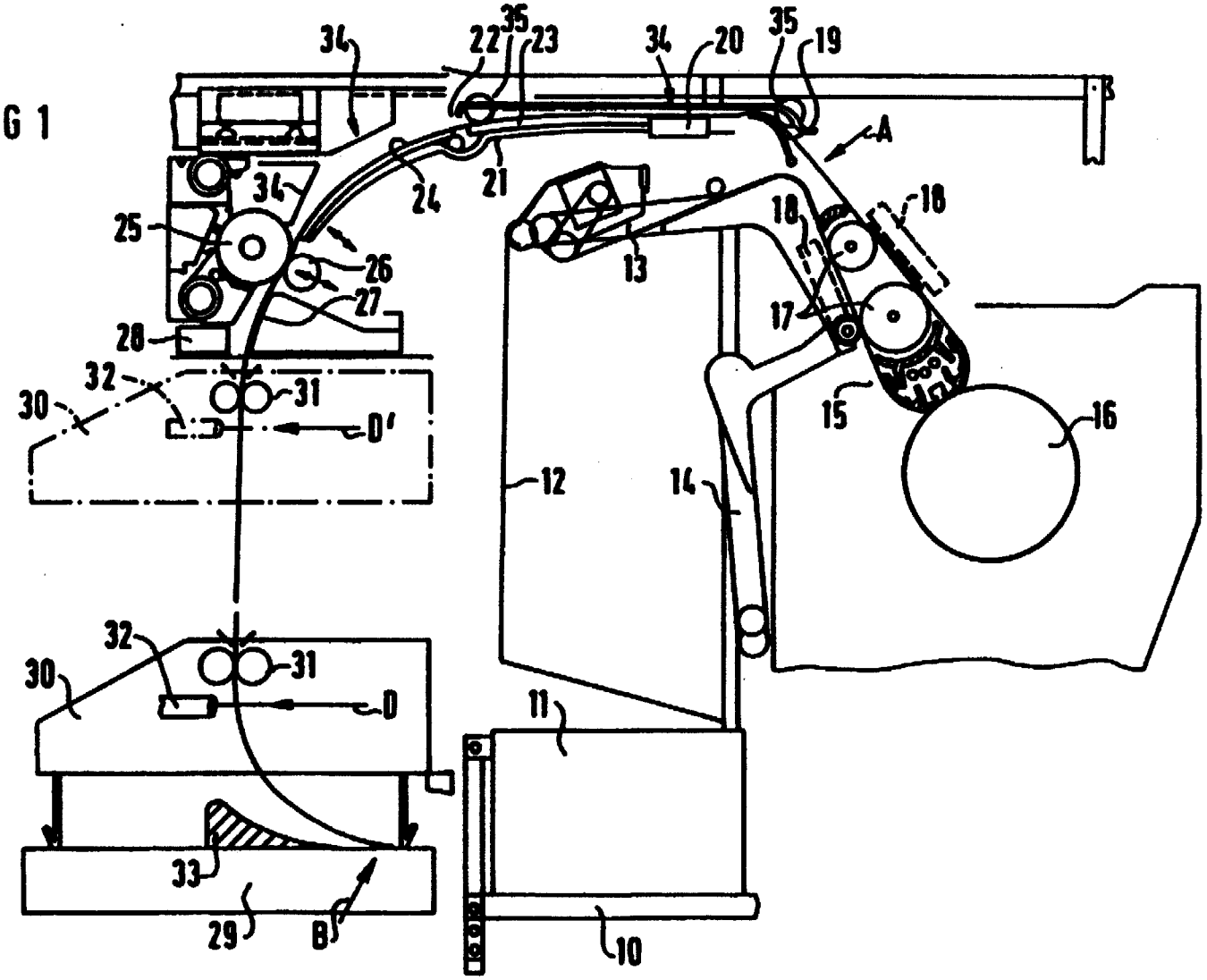
FIG. 1 shows a diagrammatic sectional illustration of an electrophotographic printing device with an arrangement for the automatic feeding of a strip-shaped printing medium.

An electrophotographic printing device contains a supply table 10 for receiving a supply stack 11 of prefolded continuous paper 12 and a pivotable actuating rocker 14, provided with a paper dividing device 13, for feeding the continuous paper 12 to a transfer printing station 15, by means of which toner images produced on a photoconductor 16 are transferred to the continuous paper 12. To transport the continuous paper 12, the transfer printing station 15 contains a tractor drive 17 with two lateral tractor strips, engaging in the edge perforations of the continuous paper 12, with transporting nipples arranged thereon. For securing and for feeding the continuous paper into the transfer printing station, four pivotably mounted tractor flaps 18 are arranged, which press the continuous paper against the tractor strips in the region of the perforation surface. Arranged downstream of the transfer printing station 15 is a fusing station for fusing the loose toner images on the continuous paper. Said fusing station contains a loop pull 19 which has the task of stabilizing the running of the paper. Furthermore, a negative pressure brake 20 which is connected via a negative pressure channel 21 to a prewarming saddle 22 of the fusing station. In this case, the prewarming saddle 22 has a fixed preheating saddle 23 and a pivotably mounted heating saddle 24.

The actual fusing of the toner images takes place in a fusing gap, arranged downstream of the prewarming saddle 22 in the paper running direction, between a heated fuser roller 25 and a nipping roller 26 which can be pivoted on and away. After leaving the fusing gap, the continuous paper 12 is guided through a cooling device, comprising a cooling saddle 27, having air outlet openings, and a cooling profile 28. After the continuous paper has left the fusing gap with the toner image fused thereon, in this cooling device cooling air is blown onto the front and back of the continuous paper in order to cool it down with the toner image. This is necessary in order to prevent the individual forms of the continuous paper sticking together during the subsequent stacking of the continuous paper.

In the outlet region of the fusing station, there is a stacking device with a stacking surface 29 and a feeding device 30 which can be raised and lowered relative to the stacking surface 29. Arranged in the feeding device 30 are motor-driven paper transporting rollers 31 with a paper detector 32, for example in the form of a light barrier. In order to facilitate the delivery of the start of the paper in the correct position, a rider in the form of a deflection element 33 is additionally provided on the stacking surface 29.

All the assemblies, such as the transfer printing station 15, loop pull 19, negative pressure brake 20, prewarming saddle 22 and cooling device 27, form a continuous resting surface for the printing medium, the continuous resting surface being a constituent part of a paper channel which leads from the transfer printing station 15 right up to the entry region to the stacking device. In this case, one wall surface of the paper channel is formed by the resting surface and the other wall surface is formed by the paper guiding elements 34.

Figure 2:
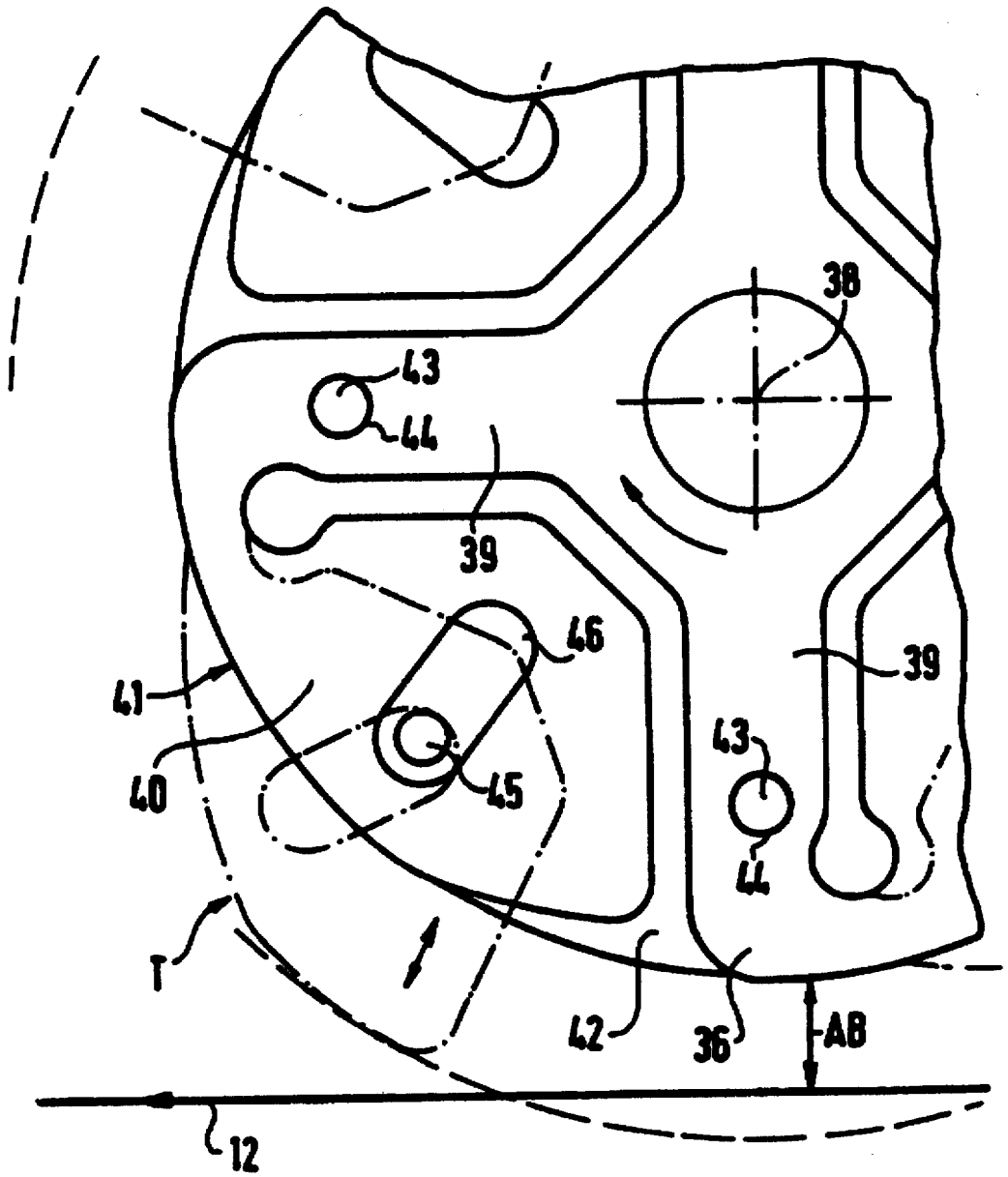
FIG. 2 shows a diagrammatic side view of a transporting element when stationary and when rotating.
Figure 3:
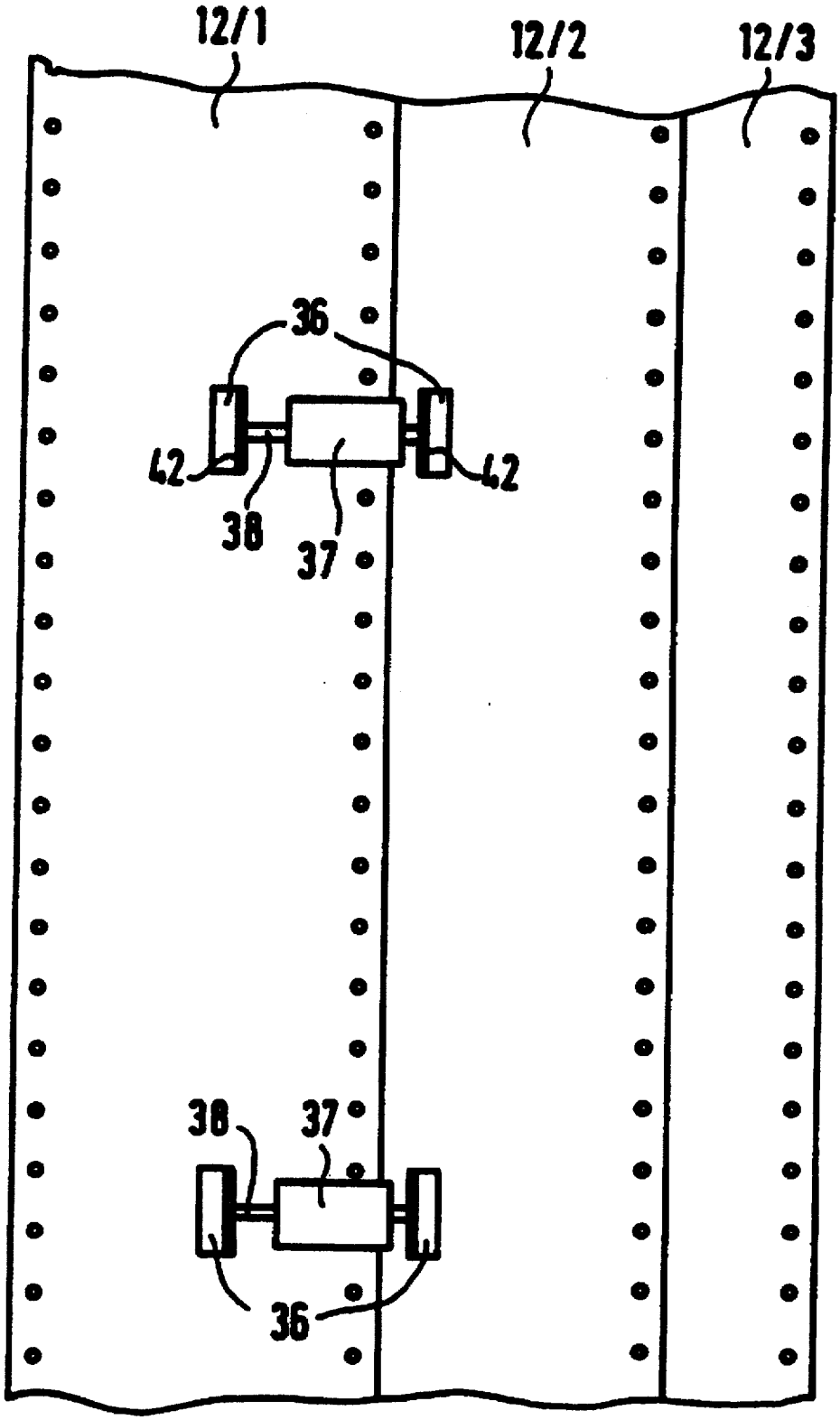
FIG. 3 shows a diagrammatic illustration of an arrangement of the transporting elements in a printing medium transport channel receiving printing media of different widths.

To support the advancing movement of the paper strip through the fusing station, an additional printing medium transporting device 35 is arranged in the transition region between the preheating saddle 23 and the heating saddle 24 and in the region of the loop pull 19, which additional transporting device is designed in such a way that it engages with the surface of the printing medium 12 and transports the latter only during the feeding operation. As illustrated in FIG. 2, the additional printing medium transporting device contains transporting elements 36 which are driven by means of a drive motor 37 (FIG. 3).

The transporting elements, which are designed as friction wheels, are produced integrally from an elastic material, e.g. Vulkollan (unmixed) L63 Shore A. They are mounted above the printing medium 12 at a distance from the printing medium 12 so as to be rotatable about an axis of rotation 38. Each of the transporting elements 36 has four webs 39 which extend radially from a central hub of the transport element 36, as illustrated in FIG. 2. Moreover, the webs 39 are arranged radially around the axis of rotation, the elements 40, designed as wheel segments, being respectively secured by the webs to the central hub so that the friction elements are arranged distributed over the circumference of the transport element 36. Each of the four friction elements 40 has a friction surface 41, each friction surface 41 approximately forming a quarter circle.

Each transporting element 36 is mounted on a holder in the form of an aluminum wheel 42 which is attached to the axis of rotation 38 of the drive motor 37, for example by means of a clamping connection. Arranged on the aluminum wheel 42 are attachment pins 43, which engage in appropriate attachment openings 44 in the transporting element 36, and stop pins 45 which, in turn, engage in stop openings 46 in the transporting element 36, which are designed in the form of elongate holes.

The friction elements 40 are designed on the webs 39 in terms of their mass and their elastic attachment in such a way that, when stationary with the friction elements 40 pivoted in, a sufficient minimum distance AB from the printing medium 12 is maintained. When the transporting elements 36 are set in rotary motion by means of the drive motors 37 corresponding to the direction of the arrow illustrated, the friction elements pivot due to the centrifugal force into the transporting position T illustrated by dot/dash lines, specifically limited in terms of their deflection path by the stop pins 45 in conjunction with the stop openings 46. As a result, the enveloping circle of the transporting elements 36 is enlarged outwards to the extent that the friction elements 40, via their friction surfaces 41, touch the surface of the printing medium 12 and transport said surface by friction. If the drive is throttled, the friction elements 40 pivot back into their rest position due to the restoring force of the elastic attachment and release the printing medium at a distance AB from the printing medium 12.

It is thus possible to assist the advancing of the printing medium 12 by driving the transporting elements 36 during the actual automatic feeding of the printing medium 12 into the printing device.

On completion of the feeding operation, or when the printing medium has reached the delivery surface 29, the drive of the transporting elements 36 is switched off and the friction elements 40 lift off from the surface of the printing medium. In the subsequent printing operation, the printing medium 12 with the loose toner images arranged thereon moves freely through the paper transport channel at the distance AB from the transporting elements 36.

In the exemplary embodiment illustrated, the transporting elements are cut out in one piece from an elastic material. It is also possible to arrange the friction elements as separate elements which are bound via spring elements to the axis of rotation. Guides may possibly be provided for this purpose. Furthermore, the friction elements 40 can consist of metal and be coated on their friction surface 41 with friction-enhancing material. Furthermore, it is possible, instead of four friction elements, to arrange a larger or smaller number of friction elements. If appropriate, a single friction element on a single web is sufficient.

In order to be able to transport printing media of very different widths using the transporting elements 36, a pair of transporting elements 36 attached on both sides of the drive motor 37 are assigned to each drive motor 37 according to the illustrations of FIG. 3. These pairs of transporting elements are arranged in the printing medium transport channel in such a way that one transporting element is located at least in the region of the narrowest printing medium 12/1 and in a region, adjacent to said region, for the wider printing media 12/2 and 12/3. In the exemplary embodiment illustrated, the narrowest printing medium 12/1 has a width of 210 mm, the medium-wide printing medium 12/2 has a width of 375 mm, and the widest printing medium 12/3 has a paper width of 457 mm. In a configuration of this type, it is favorable to arrange the pairs of transporting elements 36 in such a way that—as illustrated—during operation with the narrowest printing medium 12/1, the right-hand transporting element 36, seen in the transporting direction of the printing medium from top to bottom, runs approximately centrally relative to the printing medium. When a printing medium of medium width is printed, both transporting elements 36 engage approximately on both sides relative to the center of the printing medium. During operation with a wide printing medium 12/3, the transporting elements are arranged slightly offset from the center. In all these cases, straight guiding of the printing medium 12 is guaranteed although the latter is not engaged with pinwheels in this region. A separate lateral guidance is therefore not necessary.

The functioning of the arrangement is now explained in greater detail below with reference to the chronological sequence of the feeding operation:

After the operator has positioned the stack 11 of continuous paper on the delivery surface 10, he feeds the start of the continuous paper 12 into the transfer printing station 15 in a feed position denoted by A. For this purpose, the transfer printing station is pivoted away and a passage channel opens between the photoconductor drum 16 and the transfer printing station 15. In this case, the paper transporting rocker 14 is located in the pivoted-away position. After the paper transporting rocker 14 has been pivoted into the feeding position, the actual threading operation begins. This can be initiated by depressing an appropriate key on the operating panel or automatically by scanning the position of the paper transporting rocker 14. The feeding device 30 of the stacking device moves into the uppermost position, illustrated by interrupted lines, adjacent to the fusing station. At the same time, a line counter is started by means of the apparatus control in the control arrangement, which line counter counts the ⅙" line pulses of the paper transport 10 initiated by the apparatus control. In this case, the line pulses are the pulses which serve to define the individual printing lines on the continuous paper. They are generated in the apparatus control in conjunction with the character generator. Since a form length, i.e. a sheet of the continuous paper, contains a predetermined number of printing lines and additionally the starting position of the continuous paper is determined precisely in terms of the first form by the location of the feed position A, these line pulses can be used to determine the advancing length. Controlled by the apparatus control, the tractor drive 17 advances the continuous paper 12 via its edge perforations at a loading speed in the direction of the fusing station. In this case, the start of the continuous paper, i.e. the first form, slides on the resting surface of the assemblies. The loading speed must not be too fast since the inert mass of the continuous paper can lead to paper jams during acceleration. It must also not be too slow since otherwise the paper can be too greatly deformed when running through the warm fusing station, which in turn can cause a paper jam. As shown in tests, an optimum feeding paper speed lies between 0.3 m/s and 0.7 m/s.

Directly after leaving the transfer printing station 15, the continuous paper runs into the paper channel consisting of the resting surface and paper guiding elements. The transporting elements 36 driven by means of the drive motors 37 pick up the printing medium 12 by means of the friction surfaces 41 of the friction elements 40 and transport it through the fusing station. The advancing speed of the transporting elements 36 is selected to be slightly higher than the feeding speed of the transfer printing station 15. The paper is thus made taut. The heating saddle 24 is pivoted away from the fuser roller 25; it is in standby operation in the heated state. The nipping roller 26 is likewise pivoted away. After leaving the prewarming saddle 22, the start of the paper reaches the cooling saddle 27, slides along the latter and runs into the region of the paper transporting roller 31 of the feeding device 30. Located directly after the paper transporting rollers 31 is the paper detector 32 which detects the web of paper and, via a control arrangement, gives the command to the apparatus control to stop the further transporting of the continuous paper. It is then checked whether there is a paper jam. If there is no paper jam, the start of the continuous paper 12 is moved synchronously with the feeding device 30 down into the region of the stacking surface 29. It is then delivered by means of the stack rider 33 in a manner which is appropriate for folding.

After the paper transport has been stopped after automatic threading-in, negative pressure is applied by means of a negative pressure valve to the negative pressure brake 20 via the negative pressure channel 21 to the prewarming saddle 22, and the printing medium 12 is thus positioned on the saddle securely against displacement.

After the negative pressure has been applied, the paper transporting rollers 31 are switched off, likewise the drive of the transporting elements 36. As a result, the friction elements 40 with their friction surfaces 41 lift off from the surface of the printing medium 12. The printing operation can be started on completion of the feeding operation.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications.

What is claimed is:

1. A device for transporting printing media in printers or copiers, the device comprising:

at least one transporting element which is arranged in a printing medium transport channel at a distance from a printing medium so as to be rotatable about an axis of rotation by a drive device, the element being formed in one piece from an elastic material, and having in its circumferential region, at least one friction element with a friction surface, which friction element is deflectable relative to the axis of rotation;

wherein a centrifugal force during rotation of the transporting element causes the friction element to move from a rest position to a position wherein the friction surface is engaged in frictional contact with the printing medium to transport the printing medium; and wherein when the transporting element is stationary, a restoring force biases the friction element radially inwardly to disengage the friction element from frictional contact with the printing medium.

2. The device as claimed in claim 1, further comprising:

a device which limits a maximum deflection of the friction element.

3. The device as claimed in claim 2, having further comprising:

a holder which receives the transporting element and has a plurality of stop pins which engage in respective stop openings in the friction elements.

4. The device as claimed in claim 1, wherein the transporting element further includes:

a plurality of webs arranged radially around the axis of rotation and to which the friction elements are elastically linked.

5. The device as claimed in claim 1, wherein the multiple transporting elements are provided, the transporting elements being arranged in a printing medium transport channel which receives printing media of different widths, such that at least one transporting element is located at least in a region of narrowest printing medium and and at least one another transporting element is located in an adjacent region for the wider printing media.

6. The device as claimed in claim 5, further comprising a drive device adapted to rotate the transporting elements, wherein a pair of said transporting elements are coupled to the drive device via a common axis of rotation.

7. The device as claimed claim 1, wherein the device is arranged in the printing medium transport channel of an electrophotographic printing device as an auxiliary drive for a printing medium feeding device.

8. A device for frictionally engaging and transporting printing media, the device comprising:

at least one transporting element which is unitarily formed from an elastic material, the transporting element being drivable to rotate on a fixed axis, wherein the transporting element includes a plurality of circumferential friction elements formed therein, each of the friction elements having a friction surface, the friction surfaces generally defining a circumference of the transporting element, each of the friction elements being deflectable radially outward from a rest position to an engaging position;

wherein rotation of the transporting element causes the friction elements to deflect to the engaging position for frictional driving engagement with a printing medium; and wherein each of the friction elements is biased by the elastic material to move radially inward to the rest position when the transporting element is stationary.

9. The device as claimed in claim 8, further comprising:

a plurality of stop pins, each stop pin being arranged to limit the radially outward deflection of a corresponding said friction element.

10. The device as claimed in claim 8, wherein the transporting element further includes:

a plurality of webs, each web extending radially from an axis of said transporting element and integrally connecting to a respective friction element.

11. The device as claimed in claim 8, wherein a plurality of said transporting elements are arranged in a printing medium transport channel, the transport channel being adapted to receive printing media of various widths, at least one said transporting element being located in a region corresponding to a narrowest printing medium width and at least one said transporting element being located in an adjacent region corresponding to a wider printing media width.

12. The device as claimed in claim 11, wherein a pair of the transporting elements are coupled to a drive device on a common axis of rotation.

13. The device as claimed in claim 8, wherein the device is arranged in the printing medium transport channel of an electrophotographic printing machine as an auxiliary drive for a printing medium feeding device.

* * * * *